US008297188B2

(12) United States Patent
Liu et al.

(10) Patent No.: US 8,297,188 B2
(45) Date of Patent: Oct. 30, 2012

(54) CARBON NANOTUBE-BASED DETONATING FUSE AND EXPLOSIVE DEVICE USING THE SAME

(75) Inventors: Kai Liu, Beijing (CN); Kai-Li Jiang, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 273 days.

(21) Appl. No.: 12/653,911

(22) Filed: Dec. 17, 2009

(65) Prior Publication Data

US 2011/0146518 A1 Jun. 23, 2011

(30) Foreign Application Priority Data

Sep. 30, 2009 (CN) ..... 2009 1 0190569

(51) Int. Cl.
*C06C 5/04* (2006.01)

(52) U.S. Cl. ..... 102/275.5; 102/275.1; 977/902

(58) Field of Classification Search ..... 102/275.1, 102/275.2, 275.3, 275.4, 275.5, 275.6, 275.7, 102/275.8, 275.9, 275.11, 275.12
See application file for complete search history.

(56) References Cited

U.S. PATENT DOCUMENTS

| | | | | |
|---|---|---|---|---|
| 2005/0178282 | A1* | 8/2005 | Brooks et al. | 102/202.7 |
| 2007/0284987 | A1* | 12/2007 | Liu et al. | 313/311 |
| 2007/0296323 | A1* | 12/2007 | Liu et al. | 313/311 |
| 2010/0058945 | A1* | 3/2010 | Imholt | 102/205 |

OTHER PUBLICATIONS

Zhang et al. "Formation of metal nanowires on suspended single-walled carbon nanotubes". [Applied Physics Letters 2001, 77, 3015-3017]. 2001.*

Definition of "Coat". The American Heritage® Dictionary of the English Language, Fourth Edition copyright © 2000 by Houghton Mifflin Company. Updated in 2009. Published by Houghton Mifflin Company.*

* cited by examiner

*Primary Examiner* — Gabriel Klein
(74) *Attorney, Agent, or Firm* — Altis Law Group, Inc.

(57) ABSTRACT

A detonating fuse includes at least one CNT wire shaped structure. The at least one CNT wire shaped structure includes a plurality of CNTs and an oxidizing material. The oxidizing material is coated on an outer surface of each of the CNTs.

19 Claims, 11 Drawing Sheets

CARBON NANOTUBE-BASED DETONATING FUSE AND EXPLOSIVE DEVICE USING THE SAME

RELATED APPLICATIONS

This application claims all benefits accruing under 35 U.S.C. §119 from China Patent Application No. 200910190569.8, filed on Sep. 30, 2009 in the China Intellectual Property Office.

BACKGROUND

1. Technical Field

This disclosure relates to detonating fuses and explosive devices using the same, especially to a carbon nanotube (CNT) based detonating fuse and an explosive device using the same.

2. Description of Related Art

In an explosive, pyrotechnic device or military munition, a detonating fuse is a part of the explosive device that detonates the device. In use, the detonating fuse can be lit at a small distance from the explosive device to avoid some injury. Detonating fuses are often used in mining and military operations, to provide a time-delay before ignition.

What is needed, therefore, is to provide a safety detonating fuse and an explosive device using the same.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
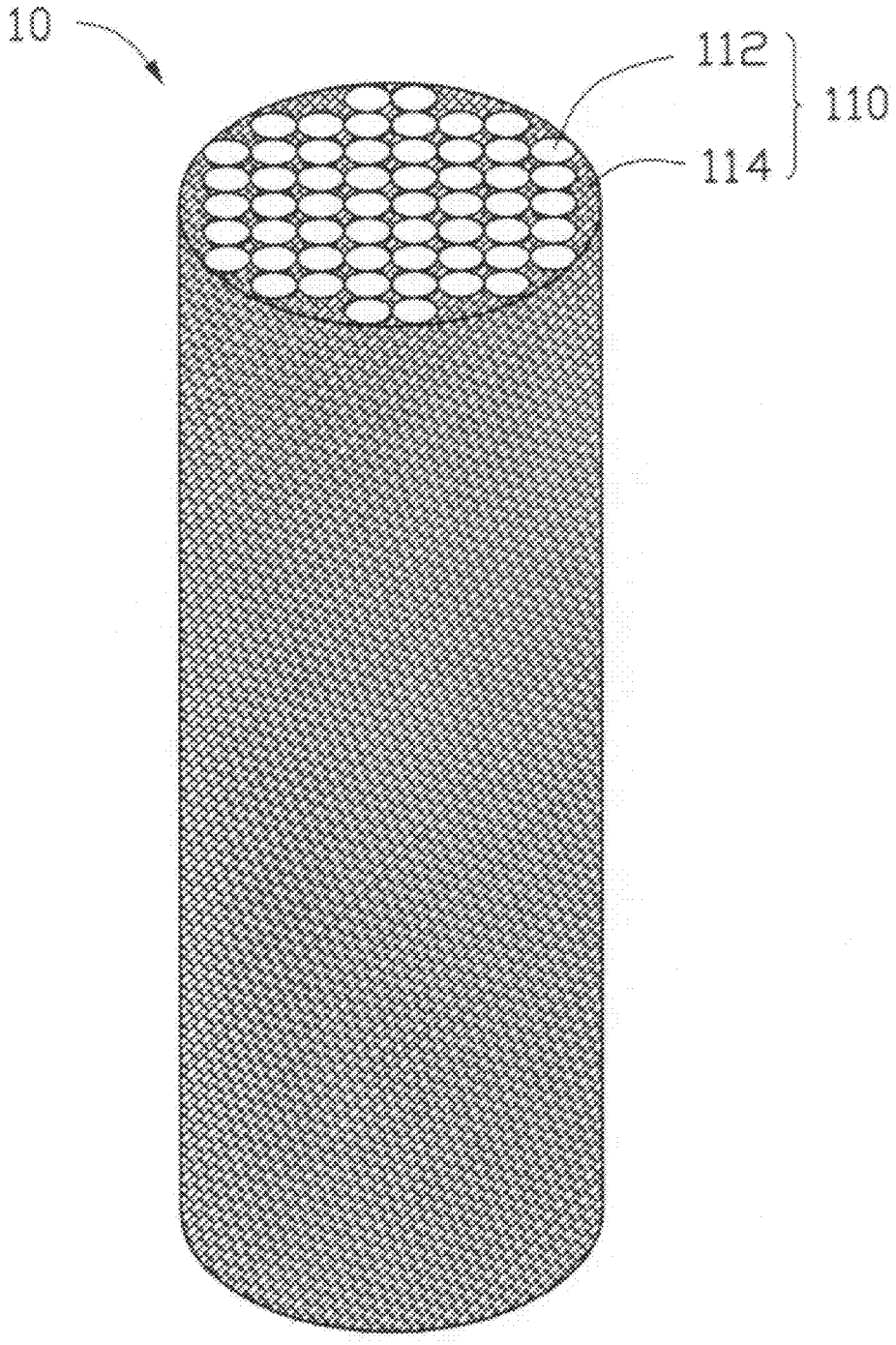
FIG. 1 is a schematic structural view of a first embodiment of a detonating fuse, the fuse including a plurality of CNTs and an oxidizing material coating the CNTs.
Figure 2:
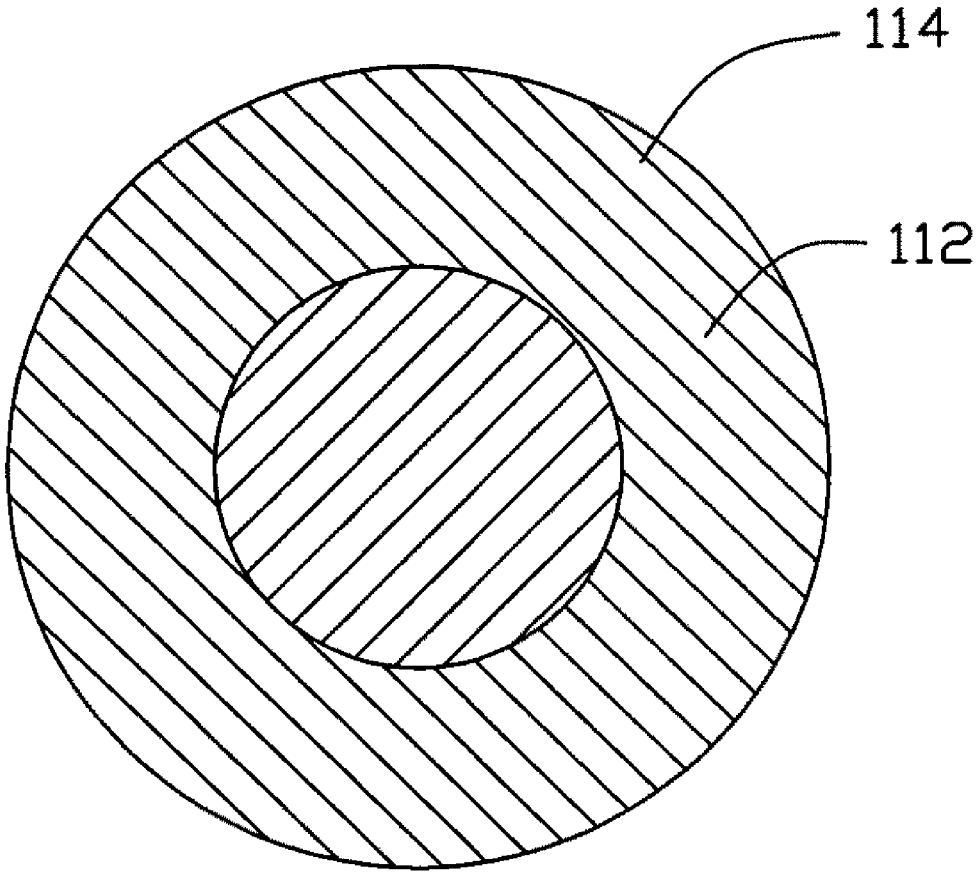
FIG. 2 is a cross-sectional view of an individual CNT coated with oxidizing material in FIG. 1.

Referring to FIG. 1 and FIG. 2, one embodiment of a detonating fuse 10 includes at least one carbon nanotube (CNT) wire shaped structure 110. The CNT wire shaped structure 110 includes a plurality of CNTs 112 and an oxidizing material 114 covering an outer surface of each of the CNTs 112. In one embodiment, the detonating fuse 10 has one CNT wire shaped structure 110.

The CNTs 112 are joined end-to-end along the wire shaped structure 110 by van der Waals attractive force between them. The CNT wire shaped structure 110 can be an untwisted CNT wire having a plurality of CNTs oriented substantially along a same direction along the length of the untwisted carbon nanotube wire. The CNTs are substantially parallel to the axis of the untwisted CNT wire. The CNT wire shaped structure 110 can also be a twisted CNT wire having a plurality of CNTs oriented substantially around an axial direction of the twisted carbon nanotube wire. The CNTs can be aligned around the axis of the carbon nanotube twisted wire in a helical manner. A diameter of the CNT wire shaped structure 110 can range from about 10 micrometers to about 100 micrometers. A weight ratio of the CNTs 112 and the oxidizing material 114 in the CNT wire shaped structure 110 can be in a range from about 1:10 to about 1:1. In one embodiment, the weight ratio of the CNTs 112 and the oxidizing material 114 in the CNT wire shaped structure 110 is in a range from about 1:5 to about 4:5. In one embodiment, the diameter of the CNT wire shaped structure 110 ranges from about 100 micrometers to about 500 micrometers.

The CNTs 112 in the CNT structure wire shaped structure 110 can be single-walled (SW), double-walled (DW), and/or multi-walled (MW) CNTs. The SWCNT may have a diameter of about 0.5 nanometers to about 10 nanometers. The DWCNT may have a diameter of about 1 nanometer to about 20 nanometers. And the MWCNT may have a diameter of about 1.5 nanometers to 100 nanometers. In one embodiment, the CNTs 112 are MWCNTs with diameters in a range from about 10 nanometers to about 100 nanometers.

Referring to FIG. 2, the oxidizing material 114 surrounds each of the CNTs 112. A thickness of the oxidizing material 114 is in a range from about 10 nanometers to about 30 nanometers. The oxidizing material 114 can be metal salts, metal oxides, or metal. The metal salts oxidize in an environment containing oxygen. The metal salts can be nitrate, potassium nitrate or ammonium nitrate. The metal can be iron, cobalt, nickel, palladium, silver or titanium. In one embodiment, the oxidizing material 114 is silver, and the weight ratio of CNTs 112 and oxidizing material 114 is 1:10. The oxidizing material 114 can also be a material that reacts easily with carbon, such as manganese oxide, potassium permanganate or potassium dichromate. The oxidizing material 114 can be ignited easily in an oxygen environment thus the detonating fuse 10 can be ignited via the oxidizing material 114.

The detonating fuse 10 can be ignited and the timing can be easily controlled, because the oxidizing material 114 coated on the CNTs 112 has a thickness from about 10 nanometers to about 30 nanometers. Thus, the detonating fuse 10 can be used in an explosive environment with an added safety measure.

It is understood that the detonating fuse 10 can include a plurality of CNT wire shaped structures 110. The plurality of CNT wire shaped structure 110 can be twisted or non-twisted. When the detonating fuse 10 includes a plurality of CNT wire shaped structures 110, the diameter of the detonating fuse 10 can range from about 20 millimeters to about 30 millimeters.

Figure 3:
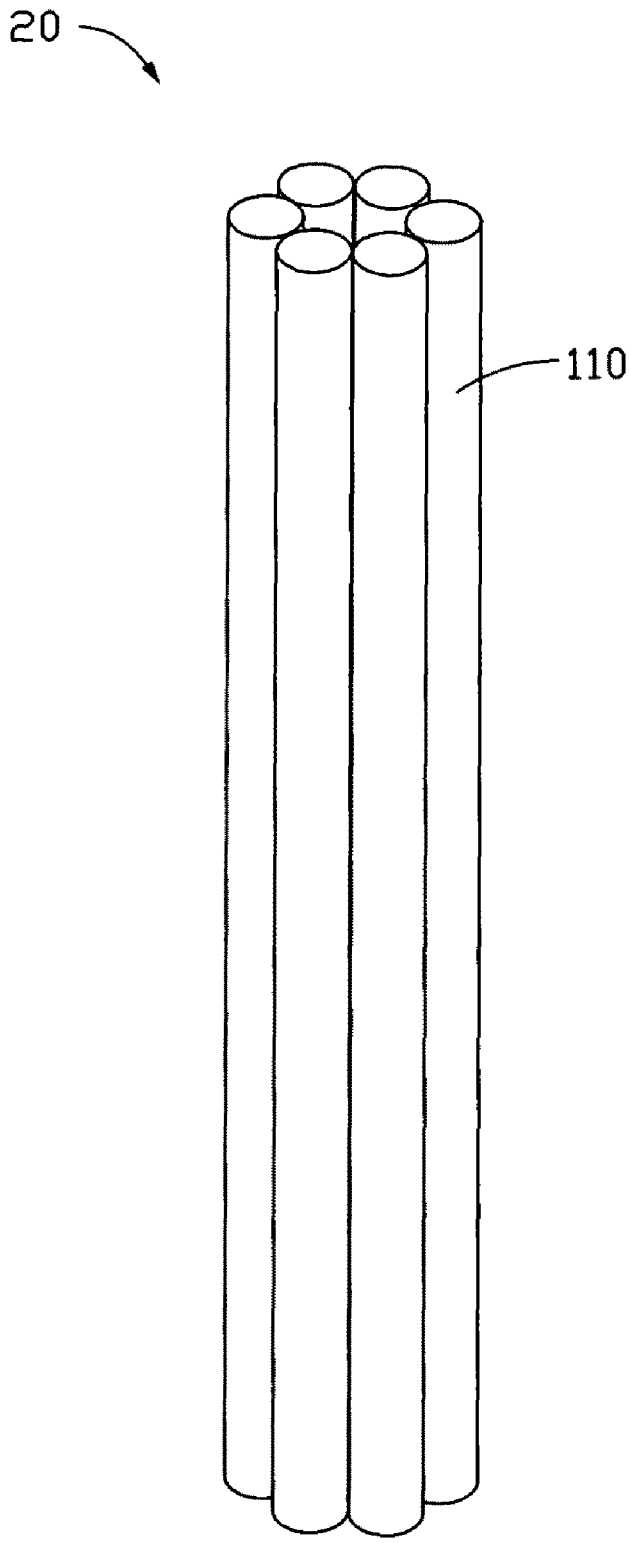
FIG. 3 is a schematic view of one embodiment of a detonating fuse.

Referring to FIG. 3, one embodiment of a detonating fuse 20 includes a plurality of CNT wire shaped structures 110. The plurality of CNT wire shaped structures 110 are substantially parallel to each other and surround an axis of the detonating fuse 20. The CNT wire shaped structures 110 are closely arranged such that the oxidizing material can be easily ignited along the axis of the detonating fuse 20. Thus, the detonating fuse 20 has good combustion characteristics.

Figure 4:
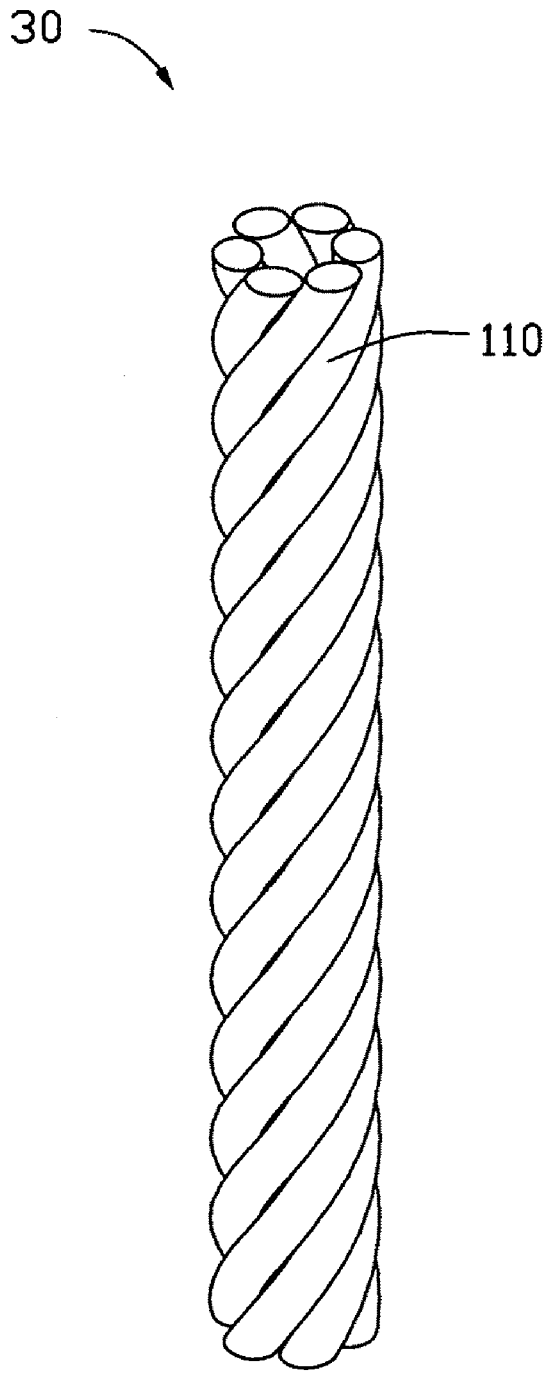
FIG. 4 is a schematic view of one embodiment of a detonating fuse.

Referring to FIG. 4, another embodiment of a detonating fuse 30 includes a plurality of CNT wire shaped structures 110. The plurality of CNT wire shaped structures 110 are twisted around an axis of the detonating fuse 30 in a helical manner, such that the CNT wire shaped structures 110 can be connected tightly and the detonating fuse 30 has a good intensity.

Figure 5:
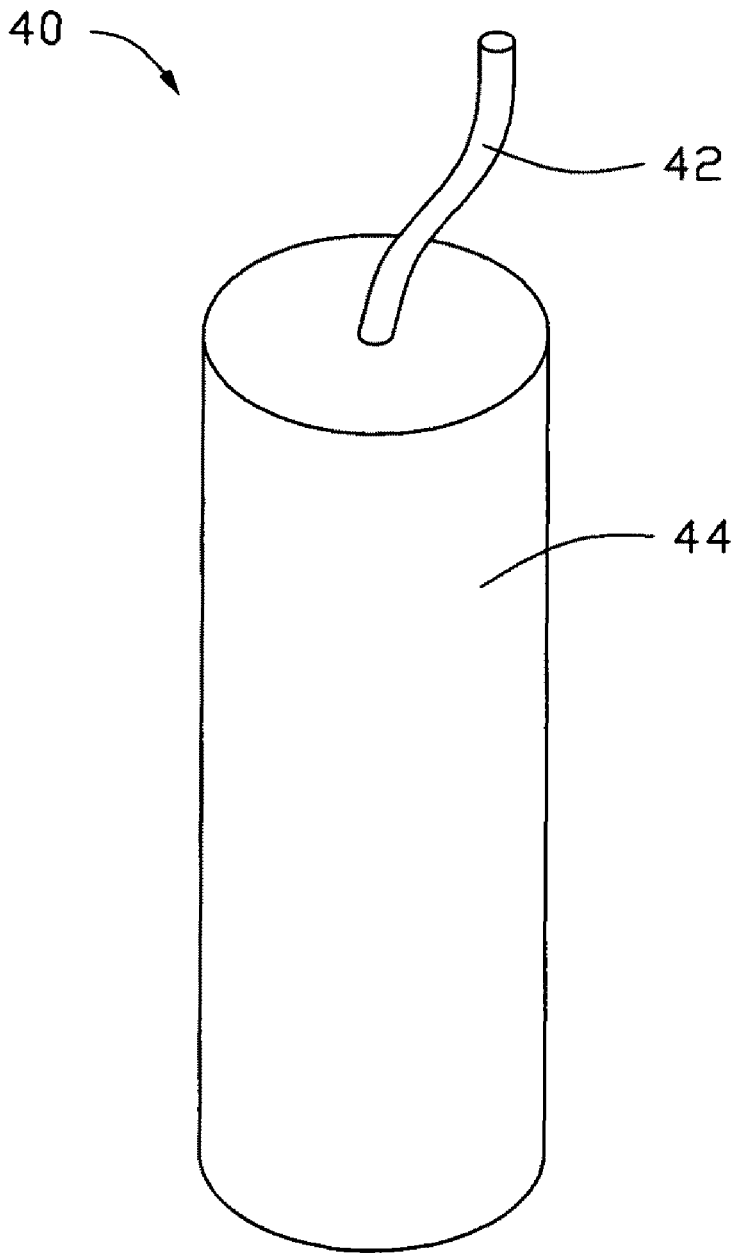
FIG. 5 is a schematic view of one embodiment of an explosive device using the detonating fuses.

Referring to FIG. 5, one embodiment of a detonation device 40 includes a detonating fuse 42 and an explosive 44. The detonating fuse 42 contacts and is capable of detonating the explosive 44. The detonating fuse 42 can be inserted into the explosive 44. The detonating fuse 42 can be any one of the detonating fuses 100, 20 or 30. The explosive 44 is a substance that is either chemically or otherwise energetically unstable or produces a sudden expansion of the material after initiation, usually accompanied by the production of heat and large changes in pressure.

Figure 6:
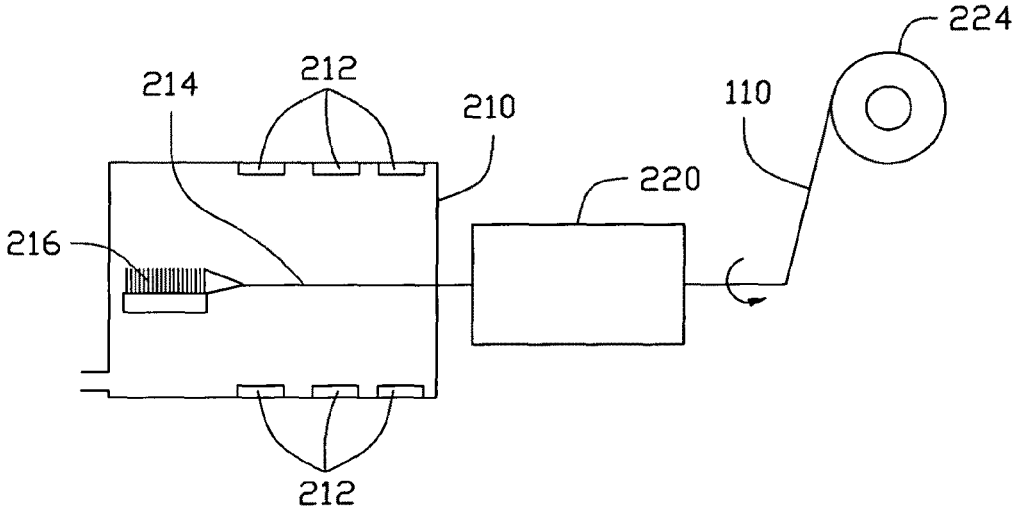
FIG. 6 is one embodiment of an apparatus for making a CNT wire structure in the detonating fuses.

Referring to FIG. 6, a method for making the CNT wire shaped structure 110 includes the following steps:

(a) providing a CNT structure 214 having a plurality of CNTs therein;

(b) coating an oxidizing material 114 on the outer surface of each of the CNTs in the CNT structure 214;

(c) forming a CNT wire shaped structure 110;

In step (a), the CNT structure 214 can be a CNT film. Step (a) can include the following steps of:

(a1) providing a CNT array 216;

(a2) pulling out a CNT film from the CNT array 216 by using a tool (e.g., adhesive tape, pliers, tweezers, or another tool allowing multiple CNTs to be gripped and pulled simultaneously).

In step (a1), a given CNT array 216 can be formed by the following substeps:

(a11) providing a substantially flat and smooth substrate;

(a12) forming a catalyst layer on the substrate;

(a13) annealing the substrate with the catalyst layer in air at a temperature ranging from about 700° C. to about 900° C. for about 30 to about 90 minutes;

(a14) heating the substrate with the catalyst layer to a temperature ranging from about 500° C. to about 740° C. in a furnace with a protective gas therein; and (a15) supplying a carbon source gas to the furnace for about 5 to 30 minutes and growing the CNT array 216 on the substrate.

In step (a11), the substrate can be a P-type silicon wafer, an N-type silicon wafer, or a silicon wafer with a film of silicon dioxide thereon. In the present embodiment, a 4-inch P-type silicon wafer is used as the substrate.

In step (a12), the catalyst can be made of iron (Fe), cobalt (Co), nickel (Ni), or any alloy thereof.

In step (a14), the protective gas can be made up of at least one of nitrogen ($N_2$), ammonia ($NH_3$), and a noble gas. In step (a5), the carbon source gas can be a hydrocarbon gas, such as ethylene ($C_2H_4$), methane ($CH_4$), acetylene ($C_2H_2$), ethane ($C_2H_6$), or any combination thereof.

The CNT array 216 can be about 200 to about 400 microns in height and include a plurality of CNTs substantially parallel to each other and approximately perpendicular to the substrate. The CNTs in the CNT array 216 can be single-walled CNTs, double-walled CNTs, or multi-walled CNTs. Diameters of the single-walled CNTs range from about 0.5 nanometers to about 10 nanometers. Diameters of the double-walled CNTs range from about 1 nanometer to about 50 nanometers. Diameters of the multi-walled CNTs range from about 1.5 nanometers to about 50 nanometers.

The CNT array 216 formed under the above conditions can be essentially free of impurities such as carbonaceous or residual catalyst particles. The CNTs in the CNT array 216 are closely packed together by van der Waals attractive force.

In step (a2), the CNT film can be formed by the following substeps:

(a21) selecting one or more CNTs having a predetermined width from the array of CNTs; and (a22) pulling the CNTs to form CNT segments that are joined end to end at an uniform speed to achieve a uniform CNT film.

In step (a21), the CNT segments can be selected by using an adhesive tape such as the tool to contact the CNT array 216. Each CNT segment includes a plurality of CNTs substantially parallel to each other.

Figure 7:
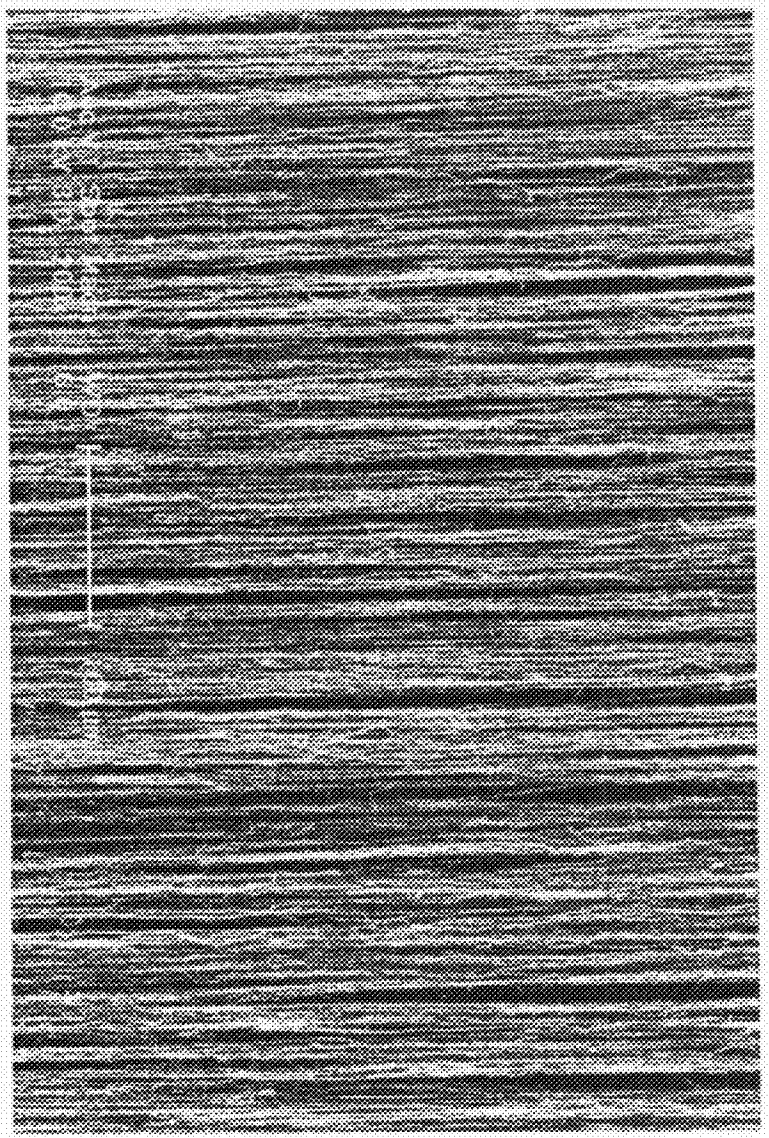
FIG. 7 shows a Scanning Electron Microscope (SEM) image of a CNT film used in one embodiment of a method for making the CNT wire structure.

More specifically, during the pulling process, as the initial CNT segments are drawn out, other CNT segments are also drawn out end-to-end due to the van der Waals attractive force between ends of adjacent segments. This process of drawing ensures that a continuous, uniform CNT film having a predetermined width can be formed. Referring to FIG. 7, the CNT film (also known as a yarn, a ribbon, a yarn string among other terms used to define the structure) includes a plurality of CNTs joined end-to-end. The CNTs in the CNT film are all substantially parallel to the pulling/drawing direction of the CNT film, and the CNT film produced in such manner can be selectively formed to have a predetermined width. The CNT film formed by the pulling/drawing method has superior uniformity of thickness and superior uniformity of conductivity over a typically disordered CNT film. Furthermore, the pulling/drawing method is simple, fast, and suitable for industrial applications.

The width of the CNT film depends on a size of the CNT array 216. The length of the CNT film can be arbitrarily set as desired. When the substrate is a 4-inch P-type silicon wafer, as in the present embodiment, the width of the CNT film ranges from about 0.01 centimeters to about 10 centimeters, and the thickness of the CNT film ranges from about 0.5 nanometers to about 100 microns.

In step (b), the oxidizing material 114 can be coated on the CNT structure 214 by a physical vapor deposition (PVD) method such as a vacuum evaporation or a sputtering. In the present embodiment, the oxidizing material 114 is coated on the CNT structure 214 by a vacuum evaporation method.

The vacuum evaporation method for forming the at least one conductive coating of step (b) can further include the following substeps:

(b1) providing a vacuum container 210 including at least one vaporizing source 212; and (b2) heating the at least one vaporizing source 212 to deposit the layer of oxidizing material 114 on each of the CNTs in the CNT structure 214.

In step (b1), the vacuum container 210 includes a depositing zone therein. At least one pair of vaporizing sources 212 includes an upper vaporizing source 212 located on a top surface of the depositing zone, and a lower vaporizing source 212 located on a bottom surface of the depositing zone. The two vaporizing sources 212 are on opposite sides of the vacuum container 210. Each pair of vaporizing sources 212 includes the oxidizing material 114. The pairs of vaporizing sources 212 can be arranged substantially along a pulling direction of the CNT structure 214 on the top and bottom surface of the depositing zone. The CNT structure 214 is located in the vacuum container 210 and between the upper vaporizing source 212 and the lower vaporizing source 212. There is a distance between the CNT structure 214 and the vaporizing sources 212. An upper surface of the CNT structure 214 faces the upper vaporizing sources 212. A lower surface of the CNT structure 214 faces the lower vaporizing sources 212. The vacuum container 210 can be evacuated by use of a vacuum pump (not shown).

Figure 8:
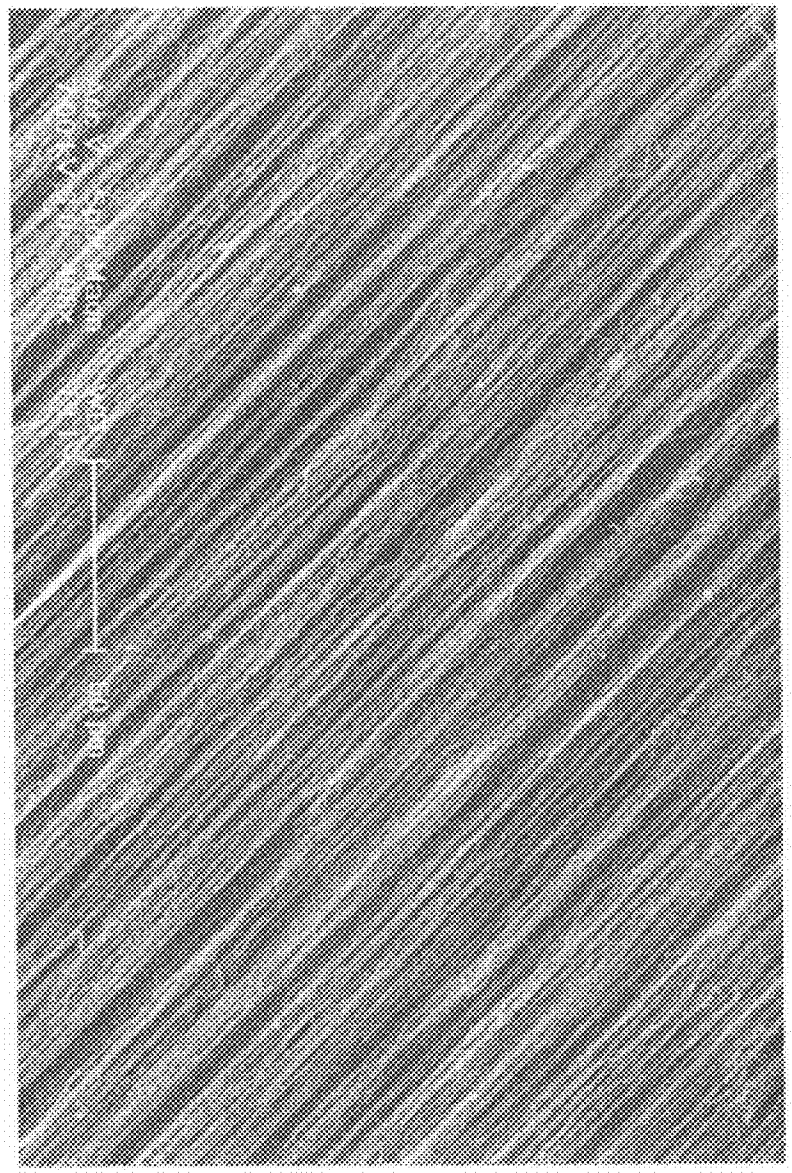
FIG. 8 shows an SEM image of the CNT film coated with the oxidizing material thereon used in the method for making the CNT structure.
Figure 9:
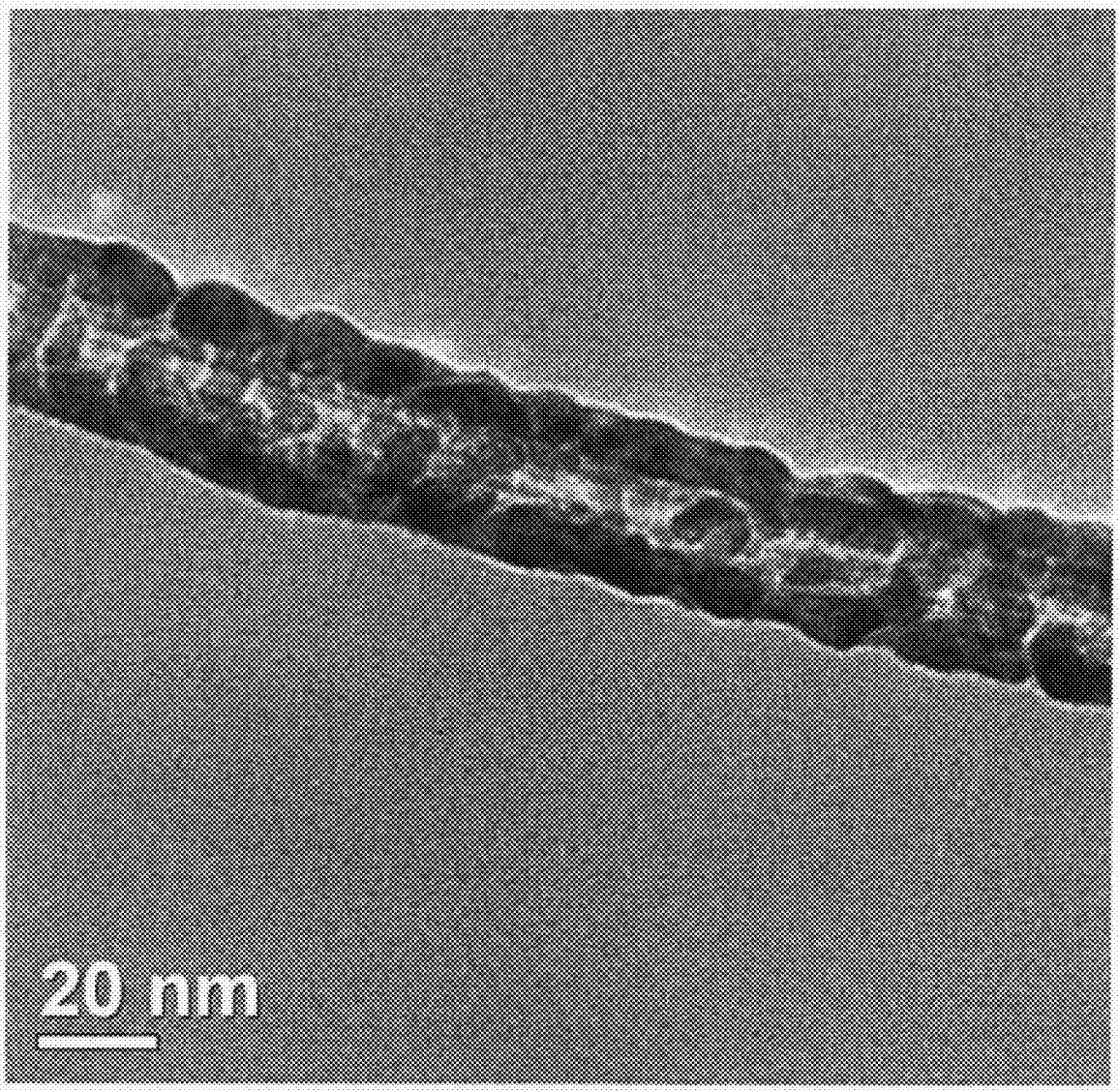
FIG. 9 shows a Transmission Electron Microscope (TEM) image of a CNT in the CNT film with the oxidizing material thereon.

In step (b2), the vaporizing source 212 can be heated by a heating device (not shown). The oxidizing material 114 in the vaporizing source 212 is vaporized or sublimed to form a gas. The gas meets the cold CNT structure 214 and coagulates on the upper surface and the lower surface of the CNT structure 214. Due to a plurality interspaces existing between the CNTs in the CNT structure 214, in addition to the CNT structure 214 being relatively thin, the oxidizing material 114 can be infiltrated in the interspaces in the CNT structure 214 between the CNTs. As such, the oxidizing material 114 can be deposited on the outer surface of most, if not all, of the single CNTs. A microstructure of the CNT structure 214 with at least one oxidizing material 114 is shown in FIG. 8 and FIG. 9.

It is to be understood that a depositing area of each vaporizing source 212 can be adjusted by varying the distance between two adjacent vaporizing sources 212 or the distance between the CNT film and the vaporizing source 212. Several vaporizing sources 212 can be heated simultaneously, while the CNT structure 214 is pulled through the depositing zone between the vaporizing sources 212 to form a layer of oxidizing material 114.

To increase a density of the gas in the depositing zone, and prevent oxidation of the oxidizing material 114, the vacuum degree in the vacuum container 210 is above 1 pascal (Pa). In one embodiment, the vacuum degree is about $4\times10^{-4}$ Pa.

It is to be understood that the CNT array 216, like the one formed in step (a1) can be directly placed in the vacuum container 210. The CNT film 214 can be pulled in the vacuum container 210 and successively pass each vaporizing source 212, with each layer of oxidizing material 114 continuously depositing. Thus, the pulling step and the depositing step can be processed simultaneously.

In step (c), if the CNT structure 214 is a CNT wire, the CNT structure 214 with at least one conductive coating thereon is a CNT wire shaped structure 110.

If the CNT structure 214 is a CNT film, step (c) with at least one conductive coating thereon can be treated with mechanical force (e.g., a conventional spinning process) in a container 220 to acquire a twisted CNT wire shaped structure 110. The CNT structure 214 is twisted substantially along an aligned direction of CNTs therein.

In the present embodiment, step (c) can be executed by three methods. The first method includes the following steps of: adhering one end of the CNT structure to a rotating motor; and twisting the CNT structure by the rotating motor. The second method includes the following steps of: supplying a spinning axis; contacting the spinning axis to one end of the CNT structure; and twisting the CNT structure by the spinning axis. The third method can be executed by cutting the CNT structure, with at least one conductive coating applied to the individual CNTs thereon, along the aligned direction of the CNTs.

A plurality of CNT wire shaped structures 110 can be stacked before being twisted to form a CNT wire shaped structure 110 with a larger diameter.

Figure 10:
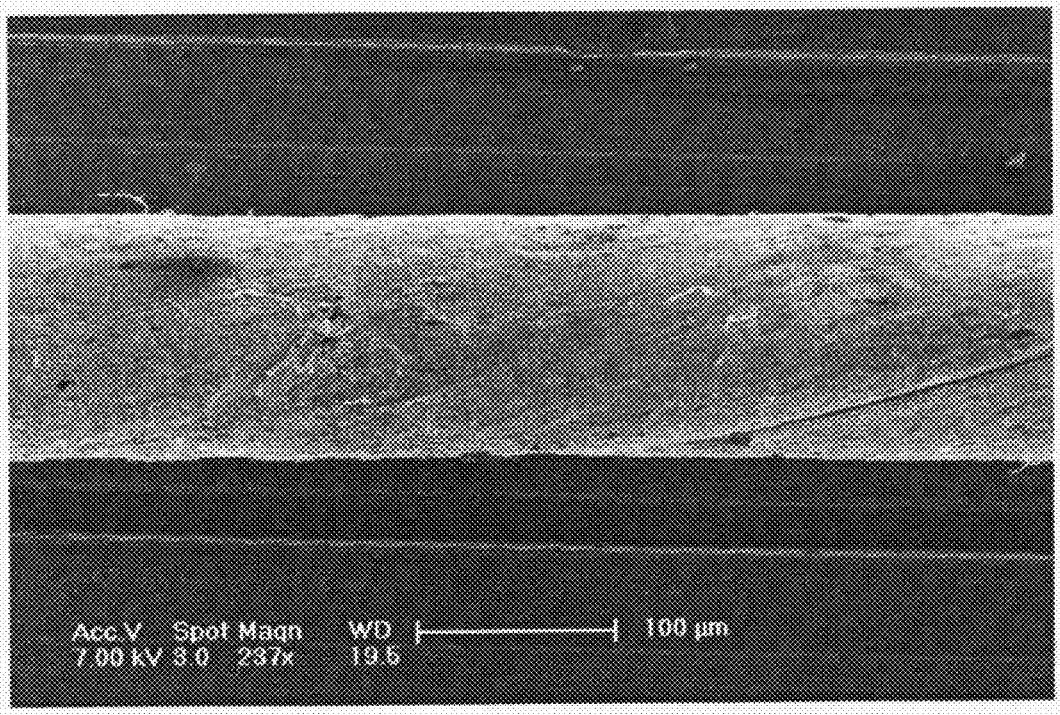
FIG. 10 shows an SEM image of a twisted CNT wire structure.
Figure 11:
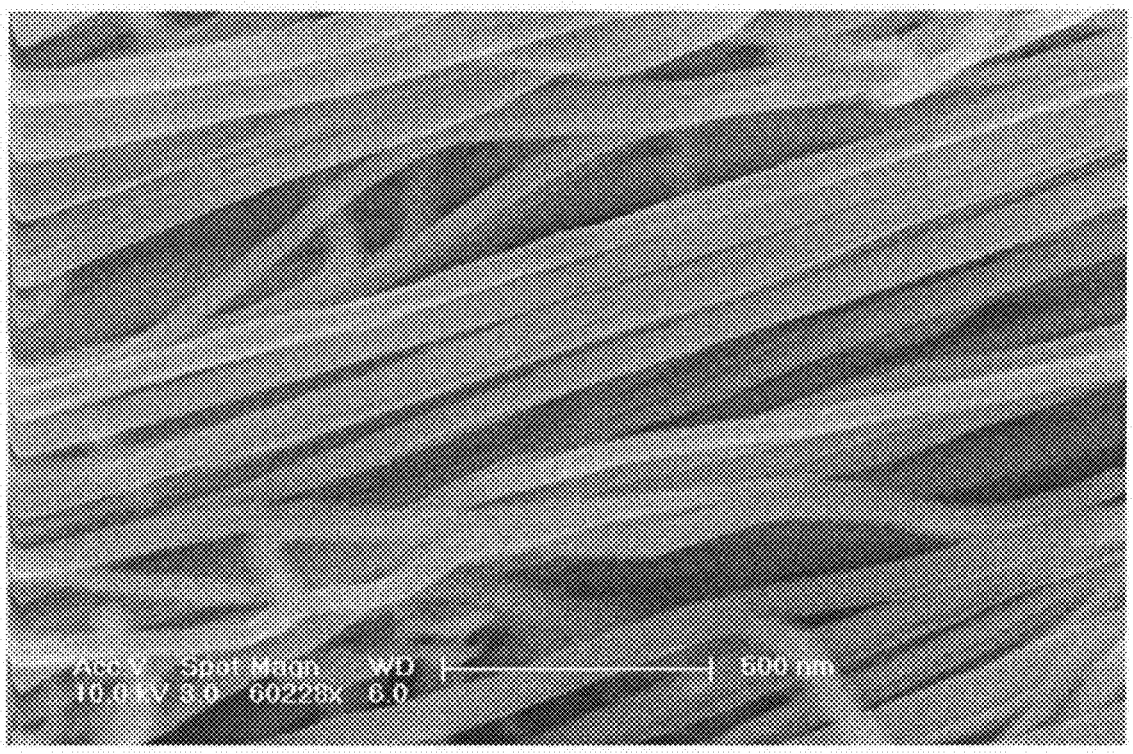
FIG. 11 shows an SEM image of the CNTs with at least one layer of oxidizing material individually coated thereon in the twisted CNT wire structure of FIG. 10.

An SEM image of a CNT wire shaped structure 110 can be seen in FIGS. 10 and 11. The CNT wire shaped structure 110 includes a plurality of CNTs with at least one oxidizing material 114 and twisted along an axis of the CNT wire shaped structure 110.

The acquired CNT wire shaped structure 110 can be further collected by a roller 224 by coiling the CNT wire shaped structure 110 onto the roller 224.

Finally, it is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A detonating fuse comprising:

at least one carbon nanotube (CNT) wire comprising a plurality of carbon nanotubes (CNTs) and an oxidizing material coated on an outer surface of each of the plurality of CNTs, wherein a diameter of the at least one CNT wire ranges from 10 micrometers to 100 micrometers, wherein the oxidizing material is metal salt, the metal salt is selected from the group consisting of nitrate, potassium nitrate or ammonium nitrate.

2. The detonating fuse of claim 1, wherein the CNTs are joined end-to-end along and parallel to an axis of the at least one CNT wire by van der Waals attractive force between them.

3. The detonating fuse of claim 2, wherein the at least one CNT wire is an untwisted CNT wire comprising a plurality of CNTs oriented along a length direction of the untwisted CNT wire.

4. The detonating fuse of claim 3, wherein the CNTs are parallel to the length direction of the untwisted CNT wire.

5. The detonating fuse of claim 2, wherein the at least one CNT wire is a twisted CNT wire comprising a plurality of CNTs oriented around the axis of the twisted CNT wire.

6. The detonating fuse of claim 5, wherein the CNTs are helically aligned around the axis of the CNT twisted wire.

7. The detonating fuse of claim 1, wherein a thickness of the oxidizing material coating on the outer surface of each of the CNTs is in a range from 10 nanometers to 30 nanometers.

8. The detonating fuse of claim 1, wherein the oxidizing material is metal salt, metal oxides or metal.

9. The detonating fuse of claim 8, wherein the metal salt is nitrate, potassium nitrate or ammonium nitrate.

10. The detonating fuse of claim 8, wherein the metal is iron, cobalt, nickel, palladium, silver or titanium.

11. The detonating fuse of claim 1, wherein a weight ratio of the CNTs and the oxidizing material in the CNT wire is in a range from 1:5 to 4:5.

12. The detonating fuse of claim 1, wherein the detonating fuse comprises a plurality of CNT wires parallel to each other and aligned along an axis of the detonating fuse.

13. The detonating fuse of claim 1, wherein the detonating fuse comprises a plurality of CNT wires twisted around an axis of the detonating fuse.

14. An explosive device comprising:

an explosive; and a detonating fuse inserted into the explosive and comprising at least one carbon nanotube (CNT) wire, the at least one CNT wire comprising a plurality of carbon nanotubes (CNTs) and an oxidizing material coating each of the plurality of CNTs, wherein a diameter of the at least one CNT wire ranges from 10 micrometers to 100 micrometers, wherein the oxidizing material is metal salt, the metal salt is selected from the group consisting of nitrate, potassium nitrate or ammonium nitrate.

15. The detonation device of claim 14, wherein the oxidizing material of the detonating fuse is metal salt, metal oxides or metal.

16. The detonation device of claim 15, wherein the metal salt is nitrate, potassium nitrate or ammonium nitrate.

17. The detonation device of claim 15, wherein the metal is iron, cobalt, nickel, palladium, silver or titanium.

18. The detonation device of claim 15, wherein a weight ratio of the CNTs and the oxidizing material in the at least one CNT wire is in a range from 1:5 to 4:5.

19. A detonating fuse comprising:

at least one carbon nanotube (CNT) wire comprising a plurality of carbon nanotubes (CNTs) and an oxidizing material coated on an outer surface of each of the plurality of CNTs, wherein the plurality of CNTs are joined end-to-end along and parallel to an axis of the at least one CNT wire by van der Waals attractive force between them, and a diameter of the at least one CNT wire ranges from 10 micrometers to 100 micrometers, wherein the oxidizing material is selected from the group consisting of nitrate, potassium nitrate or ammonium nitrate.

* * * * *